US009555450B2

(12) United States Patent
Hiramoto et al.

(10) Patent No.: US 9,555,450 B2
(45) Date of Patent: Jan. 31, 2017

(54) VACUUM CLEANING APPARATUS AND VACUUM CLEANING METHOD

(71) Applicants: IHI Corporation, Tokyo (JP); IHI Machinery and Furnace Co., Ltd., Tokyo (JP)

(72) Inventors: Noboru Hiramoto, Tokyo (JP); Masatoshi Mitsuzuka, Tokyo (JP); Hiroyuki Konishi, Tokyo (JP)

(73) Assignees: IHI CORPORATION (JP); IHI MACHINERY AND FURNACE CO., LTD. (JP)

( * ) Notice: Subject to any disclaimer, the term of this patent is extended or adjusted under 35 U.S.C. 154(b) by 320 days.

(21) Appl. No.: 14/274,883

(22) Filed: May 12, 2014

(65) Prior Publication Data

US 2014/0246056 A1 Sep. 4, 2014

Related U.S. Application Data

(63) Continuation of application No. PCT/JP2012/080105, filed on Nov. 20, 2012.

(30) Foreign Application Priority Data

Nov. 25, 2011 (JP) ..... 2011-257625

(51) Int. Cl.
*B08B 3/10* (2006.01)
*B08B 5/04* (2006.01)
(Continued)

(52) U.S. Cl.
CPC . *B08B 3/04* (2013.01); *B08B 3/00* (2013.01); *B08B 3/02* (2013.01); *B08B 3/08* (2013.01);
(Continued)

(58) Field of Classification Search
CPC ..... B08B 3/00; B08B 3/02; B08B 3/04; B08B 3/08; B08B 3/10; B08B 2230/01; B08B 5/00; B08B 5/04; C23G 5/00; F26B 5/00; F26B 5/04
See application file for complete search history.

(56) References Cited

U.S. PATENT DOCUMENTS 6,004,403 A * 12/1999 Gray ..... B01D 3/10 134/10
6,418,942 B1 * 7/2002 Gray ..... B08B 3/10 134/1.3
(Continued)

FOREIGN PATENT DOCUMENTS

CN 201135976 Y 10/2008
CN 202823972 U 3/2013
(Continued)

OTHER PUBLICATIONS

Office Action dated Jul. 14, 2014 issued in corresponding Taiwan Patent Application No. 101143622 with English translation of Search Report only.
(Continued)

*Primary Examiner* — Saeed T Chaudhry
(74) *Attorney, Agent, or Firm* — Ostrolenk Faber LLP

(57) ABSTRACT

Vacuum cleaning apparatus (1, 51) includes a vapor generating member (8, 8*a*, 53, 53*a*) for generating vapor of a petroleum-based solvent, a cleaning chamber (2) allowing a workpiece to be cleaned under reduced pressure by the vapor fed from the vapor generating member, a condensing chamber (21) that is connected to the cleaning chamber and is maintained in a depressurized state, a temperature maintaining member (22) that maintains the condensing chamber at a lower temperature than the cleaning chamber, and an opening/closing member (20) that provides or cuts off communication between the condensing chamber and the cleaning chamber.

9 Claims, 8 Drawing Sheets

(51) Int. Cl.

| | |
|---|---|
| ***C23G 5/00*** | (2006.01) |
| ***B08B 3/04*** | (2006.01) |
| ***F26B 5/04*** | (2006.01) |
| ***B08B 3/02*** | (2006.01) |
| ***B08B 3/08*** | (2006.01) |
| ***B08B 3/00*** | (2006.01) |

(52) U.S. Cl.
CPC . *B08B 3/10* (2013.01); *B08B 5/04* (2013.01); *C23G 5/00* (2013.01); *F26B 5/04* (2013.01); *B08B 2230/01* (2013.01)

(56) References Cited

U.S. PATENT DOCUMENTS

| | | | | |
|---|---|---|---|---|
| 7,444,761 | B2 * | 11/2008 | Gray | B08B 3/04 34/340 |
| 2003/0226576 | A1 | 12/2003 | Gray | 134/1 |

FOREIGN PATENT DOCUMENTS

| | | | |
|---|---|---|---|
| DE | 19527317 | A1 | 2/1996 |
| DE | 10118601 | C1 | 8/2002 |
| EP | 1 878 479 | A1 | 1/2008 |
| JP | 63-184335 | | 7/1988 |
| JP | 03-026383 | | 2/1991 |
| JP | 06-220672 | | 8/1994 |
| JP | 08-071514 | | 3/1996 |
| JP | 10-057909 | | 3/1998 |
| JP | 2000-051802 | | 2/2000 |
| JP | 2000-160378 | | 6/2000 |
| JP | 2002-59093 | | 2/2002 |
| JP | 2002-370073 | | 12/2002 |
| JP | 2003-236479 | | 8/2003 |
| JP | 2004-098022 | | 4/2004 |
| TW | 316857 | | 10/1997 |
| WO | WO 2006/129402 | | 12/2006 |

OTHER PUBLICATIONS

International Search Report and Written Opinion mailed Jan. 8, 2013 in corresponding PCT International Application No. PCT/JP2012/080105.

Extended European Search Report dated Jul. 15, 2015 issued for in corresponding European Application No. 12850922.1.

Chinese Office Action, dated May 19 2014, issued in corresponding to Chinese Patent Application No. 201210231005.6, filed Jul. 5, 2012, including English translation of Search Report. Total 10 pages.

* cited by examiner

VACUUM CLEANING APPARATUS AND VACUUM CLEANING METHOD

CROSS-REFERENCE TO RELATED APPLICATIONS

This application is a continuation of International Application No. PCT/JP2012/080105, filed Nov. 20, 2012, claiming priority to Japanese Patent Application No. 2011-257625, filed Nov. 25, 2011, the contents of both of which are incorporated herein by reference in their entity.

TECHNICAL FIELD

The present invention relates to vacuum cleaning apparatus and a vacuum cleaning method in which vapor of a petroleum-based solvent is fed to a cleaning chamber under reduced pressure to clean a workpiece.

BACKGROUND ART

Conventionally, vacuum cleaning apparatus disclosed in, for instance, Patent Document 1 is known. According to the vacuum cleaning apparatus, first, a depressurizing process of depressurizing a vapor cleaning and drying chamber into which a workpiece is loaded using a vacuum pump is performed. Afterwards, a vapor cleaning process of feeding vapor of a petroleum-based solvent to the vapor cleaning and drying chamber to clean the workpiece is performed. Next, an immersing and cleaning process of immersing the workpiece in the petroleum-based solvent stored in an immersion chamber and cleaning gaps in the workpiece which were particularly insufficiently cleaned in the vapor cleaning process is performed.

When the cleaning of the workpiece is completed in this way, the workpiece is transferred to the vapor cleaning and drying chamber again. Afterwards, a drying process of further depressurizing the vapor cleaning and drying chamber to evaporate the solvent adhered to a surface of the workpiece is performed. Then, when the drying process is completed, the vapor cleaning and drying chamber is restored to atmospheric pressure. Afterwards, the workpiece is unloaded, thus completing a series of processes.

CITATION LIST

Patent Document

[Patent Document 1]
Japanese Unexamined Patent Application, First Publication No. 2003-236479

SUMMARY OF INVENTION

Technical Problem

According to the vacuum cleaning apparatus of Patent Document 1, in the drying process, the vapor cleaning and drying chamber is depressurized by vacuum evacuation caused by the vacuum pump. Here, it is not easy to exhaust and dry a gas gasified to a volume more than 100 times by evaporation using a conventional vacuum pump of a mechanical rotary type. Further, if the pressure is further reduced to enhance a drying characteristic, the gas is additionally expanded and an exhaust time increases. For this reason, the drying process based on the conventional drying method takes a long time. In other words, there is a need to shorten such a time in the drying process of enhancing stable cleaning quality and productivity.

Accordingly, an object of the present invention is to provide vacuum cleaning apparatus and a vacuum cleaning method capable of shortening a time required to dry a workpiece to improve overall treatment capacity.

Solution to Problem

To solve this problem, the present invention provides the following means. A first aspect of the present invention is vacuum cleaning apparatus. The vacuum cleaning apparatus includes: a vapor generating member configured to generate vapor of a petroleum-based solvent; a cleaning chamber configured to allow a workpiece to be cleaned under reduced pressure by the vapor fed from the vapor generating member; a condensing chamber that is connected to the cleaning chamber and is kept in a depressurized state; a temperature maintaining member configured to maintain the condensing chamber at a lower temperature than the cleaning chamber, and an opening/closing member configured to provide or cut off communication between the condensing chamber and the cleaning chamber.

A second aspect of the present invention is configured such that, in the vacuum cleaning apparatus according to the first aspect, the temperature maintaining member is configured to maintain the temperature of the condensing chamber at a temperature equal to or lower than a condensation point of the petroleum-based solvent.

A third aspect of the present invention is configured such that the vacuum cleaning apparatus according to the second aspect further includes a collecting member configured to guide the petroleum-based solvent, which is guided and condensed from the cleaning chamber to the condensing chamber, from the condensing chamber to the vapor generating member.

A fourth aspect of the present invention is configured such that the vacuum cleaning apparatus according to any one of the first to third aspects further includes an immersion chamber which is connected to the cleaning chamber, in which the petroleum-based solvent is stored, and which allows the workpiece to be immersed in the petroleum-based solvent.

A fifth aspect of the present invention is a vacuum cleaning method. The vacuum cleaning method includes: a process of depressurizing a cleaning chamber into which a workpiece is loaded and a condensing chamber connected to the cleaning chamber; a process of generating vapor of a petroleum-based solvent and feeding the vapor to the cleaning chamber under reduced pressure to clean the workpiece; a process of maintaining the condensing chamber under reduced pressure at a lower temperature than the cleaning chamber, and a process of providing communication between the condensing chamber and the cleaning chamber after the workpiece is cleaned in the cleaning chamber.

Advantageous Effects of Invention

According to the present invention, it is possible to shorten a time required to dry a workpiece to improve overall treatment capacity.

DESCRIPTION OF EMBODIMENTS

Figure 1:
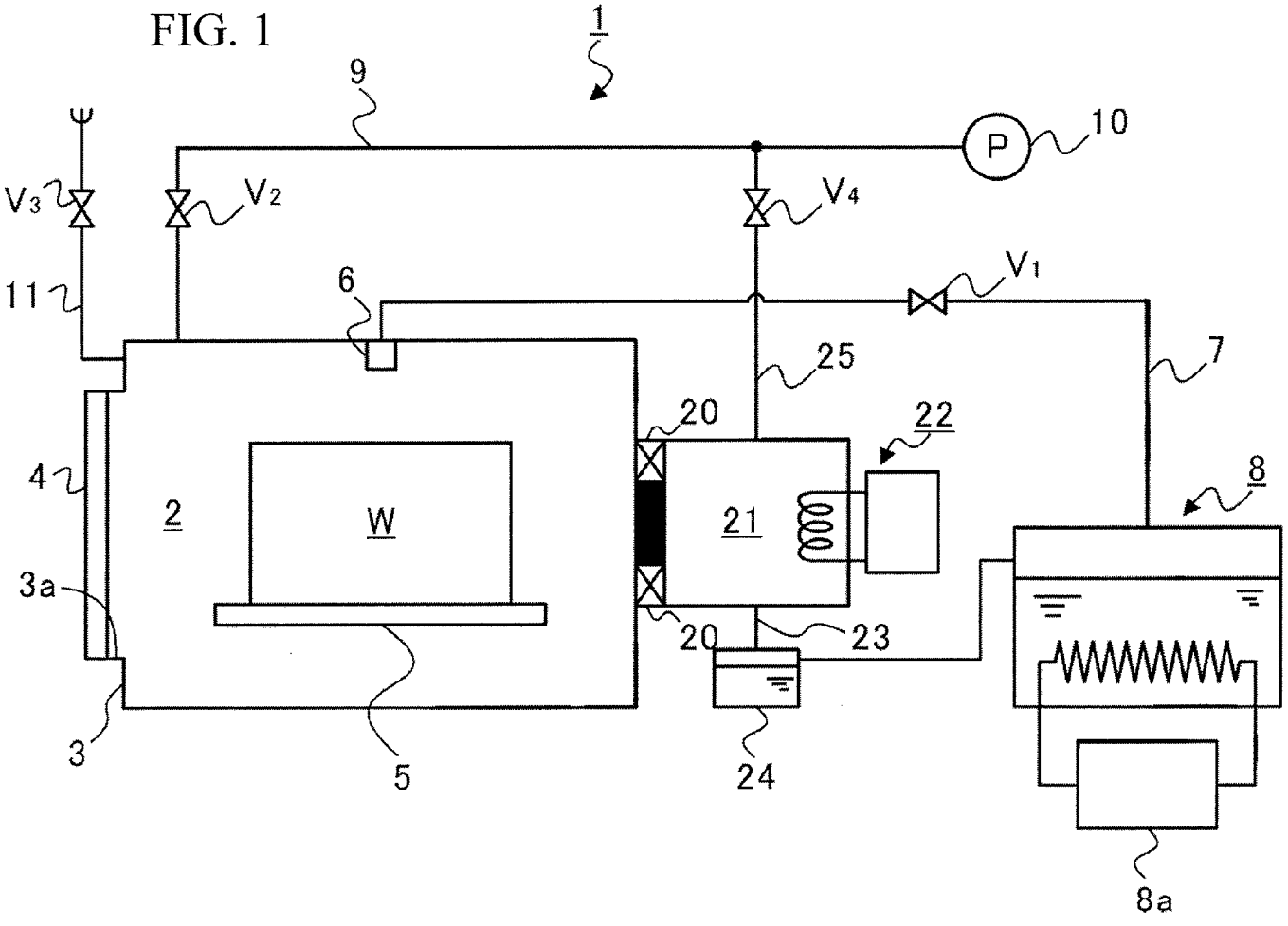
FIG. 1 is a conceptual diagram for describing vacuum cleaning apparatus 1 of a first embodiment.

Hereinafter, preferred embodiments of the present invention will be described in detail with reference to the attached drawings. Dimensions, materials, other specific numerical values, and so on indicated in these embodiments are merely examples for facilitating comprehension of the invention, and unless indicated otherwise, the present invention is not limited thereto. Note that, in the specification and drawings, elements having substantially the same functions and constitutions will be given the same reference numerals, and duplicate description thereof will be omitted. Further, elements not directly related to the present invention are not illustrated in the drawings.

FIG. 1 is a conceptual diagram for describing vacuum cleaning apparatus 1 of a first embodiment. As shown in FIG. 1, vacuum cleaning apparatus 1 is provided with a vacuum container 3 in which a cleaning chamber 2 is formed. This vacuum container 3 is provided with an opening 3*a*. The opening 3*a* can be opened and closed by an opening/closing door 4. Thus, when a workpiece W is cleaned, the opening/closing door 4 is opened, and the workpiece W is loaded into the cleaning chamber 2 through the opening 3*a* and placed on a mounting part 5. Afterwards, the opening/closing door 4 is closed, and the workpiece W is cleaned. Then, the opening/closing door 4 is opened again, and the workpiece W is unloaded through the opening 3*a*.

The cleaning chamber 2 is provided with a vapor feeding part 6. The vapor feeding part 6 is connected to a vapor generating chamber 8 via a vapor feed pipe 7. The vapor generating chamber 8 is provided with a heater 8*a*, and heats a petroleum-based solvent to generate solvent vapor (hereinafter simply referred to as "vapor"). In this way, the vapor generated by the vapor generating chamber 8 is fed to the cleaning chamber 2 via the vapor feed pipe 7 and the vapor feeding part 6. A type of the petroleum-based solvent is not particularly limited. However, from the viewpoint of safety, a third class petroleum-based solvent is preferably used, and includes, for instance, an n-paraffinic hydrocarbon-based solvent, an isoparaffinic hydrocarbon-based solvent, a naphthenic hydrocarbon-based solvent, or an aromatic hydrocarbon-based solvent. In detail, as the third class petroleum-based solvent, TECLEAN® N20, Cleansol G, and DAPHNE® solvents, which are generally known as cleaning solvents, are preferably used. TECLEAN® is a registered trademark of Nippon Oil Corporation (which is now called JX Holdings, Inc.), and "Cleansol G" is a trade name of the same company. DAPHNE® is a registered trademark of Idemitsu Kosan Co., Ltd.

Further, a vacuum pump 10 is connected to the cleaning chamber 2 via a pipe 9. In a depressurizing process prior to starting to clean the workpiece W, the vacuum pump 10 depressurizes an inside of the vacuum container 3 by means of vacuum evacuation (initial vacuum). Furthermore, a pipe 11 for exposing the cleaning chamber 2 to the atmosphere is connected to the cleaning chamber 2. In an unloading process after cleaning and drying processes of the workpiece W are completed, the pipe 11 exposes the cleaning chamber 2 to the atmosphere, and returns the cleaning chamber 2 to atmospheric pressure.

A condensing chamber 21 is connected to the cleaning chamber 2 via an opening/closing valve 20 that is an opening/closing member. When the opening/closing valve 20 is opened, the cleaning chamber 2 and the condensing chamber 21 communicate with each other. When the opening/closing valve 20 is closed, the communication between the cleaning chamber 2 and the condensing chamber 21 is cut off. Like the cleaning chamber 2, the condensing chamber 21 is also connected to the vacuum pump 10 via a branch pipe 25 branching off from the pipe 9, and can maintain a depressurized state. Further, the condensing chamber 21 is provided with a temperature maintaining device (temperature maintaining member) 22 made up of a heat exchanger, and a temperature in the condensing chamber 21 can be maintained at a constant temperature (from 5° C. to 50° C., more preferably from 15° C. to about 25° C.), the constant temperature being lower than a temperature in the cleaning chamber 2.

Furthermore, a reservoir tank 24 is connected to the bottom of the condensing chamber 21 via a return pipe 23. The petroleum-based solvent condensed by the condensing chamber 21 is guided from the return pipe 23 to the reservoir tank 24, and can be temporarily stored in the reservoir tank 24. The reservoir tank 24 is connected to the vapor generating chamber 8. When the petroleum-based solvent is stored above a predetermined amount, the petroleum-based solvent is guided from the reservoir tank 24 to the vapor generating chamber 8. In other words, the return pipe 23 and the reservoir tank 24 function as collecting member for collecting the petroleum-based solvent. The petroleum-based solvent collected by this collecting member reflows to the vapor generating chamber 8, is evaporated again, and is fed to the cleaning chamber 2.

As shown in FIG. 1, the vapor feed pipe 7 is provided with a switching valve $V_1$ that provides or cuts off communication between the cleaning chamber 2 and the vapor generating chamber 8. The pipe 9 is provided with a switching valve $V_2$ that provides or cuts off communication between the cleaning chamber 2 and the vacuum pump 10. The pipe 11 is provided with a switching valve $V_3$ that exposes the cleaning chamber 2 to the atmosphere or cuts off the cleaning chamber 2 from the atmosphere. The branch pipe 25 is provided with a switching valve $V_4$ that provides or cuts off communication between the condensing chamber 21 and the vacuum pump 10.

Next, a vacuum cleaning method of the workpiece W in the vacuum cleaning apparatus 1 will be described using FIGS. 1 and 2. Hereinafter, to specifically describe the vacuum cleaning method in the vacuum cleaning apparatus 1, a case in which TECLEAN® N20, which is a third class petroleum-based solvent, is used as the petroleum-based solvent will be described. However, as described above, the petroleum-based solvent capable of being used in the vacuum cleaning apparatus 1 is not limited thereto. When a control temperature is changed in various devices depending on characteristics such as a boiling point and a condensation point of the petroleum-based solvent to be used, various petroleum-based solvents can be used.

Figure 2:
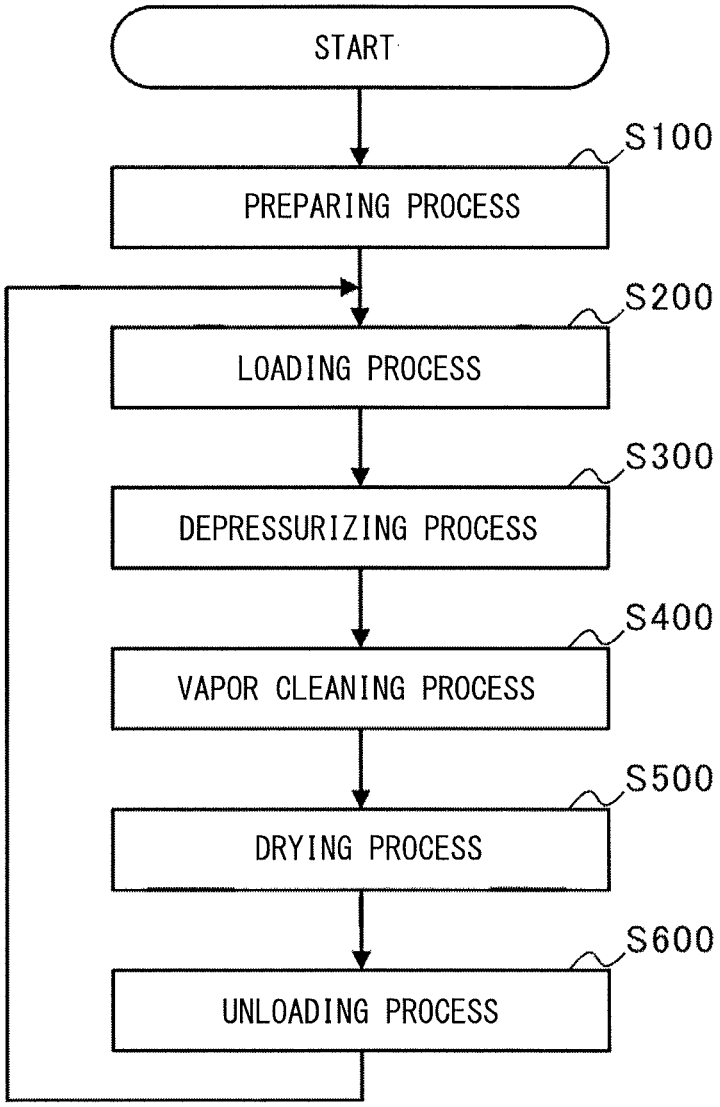
FIG. 2 is a flow chart describing treatment processes of the vacuum cleaning apparatus of the first embodiment.

FIG. 2 is a flow chart describing treatment processes of the vacuum cleaning apparatus 1. In using the vacuum cleaning apparatus 1, first, a preparing process (step S100) is performed once. Then, a loading process (step S200), a depressurizing process (step S300), a vapor cleaning process (step S400), a drying process (step S500), and an unloading process (step S600) are performed on one workpiece W. Thereafter, the processes of steps S200 to S600 are performed on subsequently loaded workpieces W. Hereinafter, each process will be described with reference to FIG. 1.

(Preparing Process: Step S100)

First, the vacuum cleaning apparatus 1 is operated. To this end, the opening/closing valve 20 and the switching valves $V_1$ to $V_3$ are closed, and the switching valve $V_4$ is opened to drive the vacuum pump 10. Thereby, the condensing chamber 21 undergoes vacuum evacuation, and an interior of the condensing chamber 21 is reduced to a pressure equal to or less than 10 kPa. Then, the temperature maintaining device 22 is driven, and the condensing chamber 21 that is in a depressurized state is maintained at a temperature lower than that of the cleaning chamber 2, more particularly at a temperature (from 5° C. to 50° C., more preferably from 15° C. to about 25° C.), the temperature being lower than the condensation point of the petroleum-based solvent to be used.

Further, the heater 8*a* is driven to heat the petroleum-based solvent stored in the vapor generating chamber 8, thereby generating vapor. In this case, the vapor generating chamber 8 reaches a saturated vapor pressure, and the switching valve $V_1$ is closed. As such, the vapor generated at the vapor generating chamber 8 is filled in the vapor generating chamber 8. Thereby, the preparing process of the vacuum cleaning apparatus 1 is completed, and the workpiece W can be cleaned by the vacuum cleaning apparatus 1.

(Loading Process: Step S200)

When the cleaning of the workpiece W is performed by the vacuum cleaning apparatus 1, the opening/closing door 4 is opened first, and the workpiece W is loaded through the opening 3*a* into the cleaning chamber 2 and placed on the mounting part 5. In this case, the opening/closing valve 20 is still closed, and the condensing chamber 21 is maintained in the depressurized state. Then, when the loading of the workpiece W is completed, the opening/closing door 4 is closed to keep the cleaning chamber 2 closed tightly. In this case, the temperature of the workpiece W is room temperature (from about 15° C. to about 40° C.).

(Depressurizing Process: Step S300)

Next, the vacuum pump 10 is driven to depressurize the cleaning chamber 2 to the pressure equal to or less than 10 kPa that is the same as that of the condensing chamber 21 by means of vacuum evacuation.

(Vapor Cleaning Process: Step S400)

Next, the switching valve $V_1$ is opened to feed the vapor generated by the vapor generating chamber 8 to the cleaning chamber 2. Here, a temperature of the vapor is controlled to a temperature from 70° C. to 150° C. (more preferably from 115° C. to 125° C.), and the cleaning chamber 2 is filled with the high-temperature vapor.

In this way, when the vapor fed to the cleaning chamber 2 is adhered to a surface of the workpiece W, the temperature of the workpiece W is lower than that of the vapor. As such, the vapor is condensed on the surface of the workpiece W. As a result, oils and fats adhered to the surface of the workpiece W are dissolved to flow down by the condensed petroleum-based solvent, and the workpiece W is cleaned. This vapor cleaning process is performed until the temperature of the workpiece W reaches the temperature from 70° C. to 150° C. (from 115° C. to 125° C.) that is the temperature of the vapor (the boiling point of the petroleum-based solvent), and the switching valve $V_1$ is closed when the temperature of the workpiece W reaches the temperature of the vapor. Thereby, the vapor cleaning process comes to an end.

(Drying Process: Step S500)

When the vapor cleaning process of step S400 is completed, then the drying process of drying the petroleum-based solvent adhered to the workpiece W in the event of the cleaning is performed. The drying process is performed by opening the opening/closing valve 20 to cause the cleaning chamber 2 and the condensing chamber 21 to communicate with each other. To be specific, upon initiating the drying process, the temperature of the cleaning chamber 2 is the temperature from 70° C. to 150° C. that is the temperature of the vapor. However, the temperature of the condensing chamber 21 is maintained at a temperature from 5° C. to 50° C. (more preferably from 15° C. to 25° C.) by the temperature maintaining device 22.

Accordingly, when the opening/closing valve 20 is opened, the vapor filled in the cleaning chamber 2 is moved to and condensed in the condensing chamber 21. Thereby, since the cleaning chamber 2 is depressurized, the petroleum-based solvent adhered to the workpiece W and the petroleum-based solvent inside the cleaning chamber 2 are all evaporated to move to the condensing chamber 21. As a result, the cleaning chamber 2 (and the workpiece W) can be dried in a very short time, compared to the related art. A drying time in the vacuum cleaning apparatus 1 of the first embodiment will be described below in detail.

(Unloading Process: Step S600)

As described above, when the drying of the cleaning chamber 2 and the workpiece W is completed, the opening/closing valve 20 is closed to cut off the cleaning chamber 2 and the condensing chamber 21. Then, the switching valve $V_3$ is opened to expose the cleaning chamber 2 to the atmosphere, and when the cleaning chamber 2 is restored to the atmospheric pressure, the opening/closing door 4 is opened to unload the workpiece W through the opening 3*a*. Thereby, all the processes for the workpiece W are completed. Here, since the condensing chamber 21 is maintained at a desired pressure, the other workpieces W can be continuously cleaned by repeating steps S200 to S600 thereafter.

Figure 3:
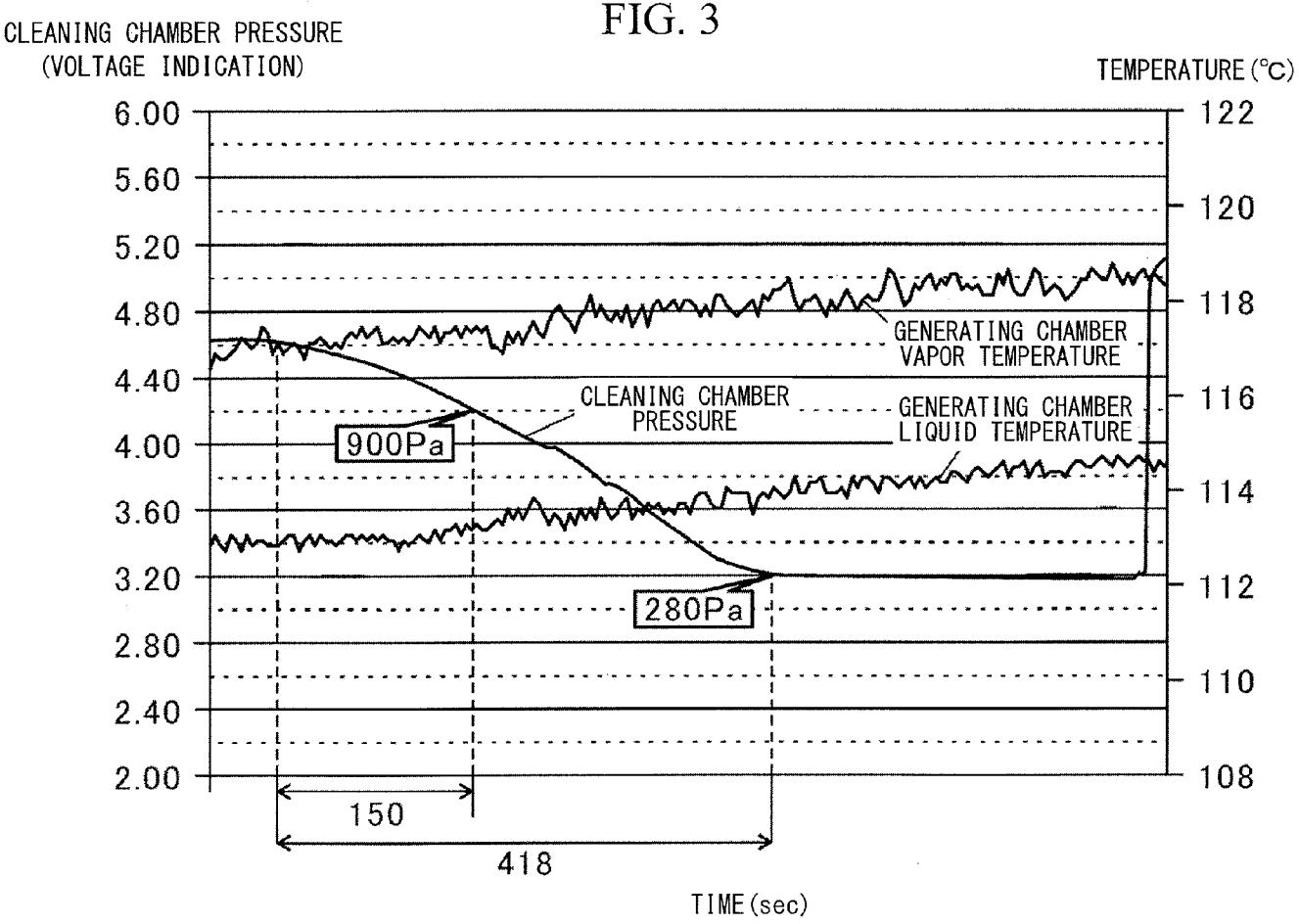
FIG. 3 is a diagram showing test data of a drying process based on conventional vacuum cleaning apparatus.
Figure 4:
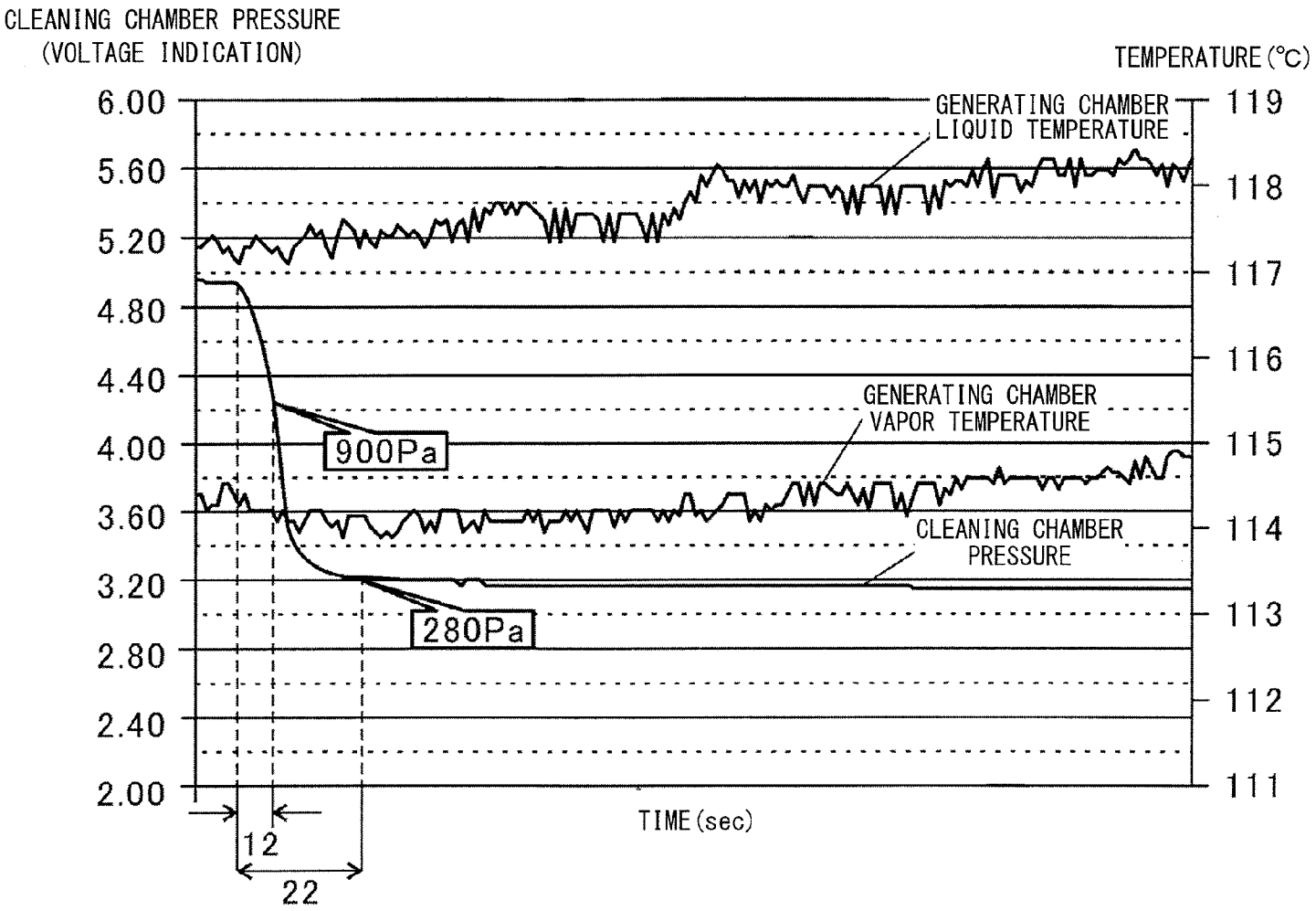
FIG. 4 is a diagram showing test data of a drying process based on the vacuum cleaning apparatus of the first embodiment.

FIG. 3 is a diagram showing test data of a drying process based on conventional vacuum cleaning apparatus. FIG. 4 is a diagram showing test data of a drying process based on the vacuum cleaning apparatus 1 of the first embodiment. FIGS. 3 and 4 show various data when 150 kg of a small metal part is dried as a workpiece W under almost the same conditions. Further, when the cleaning chamber 2 is depressurized in the drying process, the conventional vacuum cleaning apparatus is subjected to vacuum evacuation by a special vacuum pump for vapor. Only this point is different from the vacuum cleaning apparatus 1 of the first embodiment, and all the other constitutions are the same.

As shown in FIG. 3, in the conventional vacuum cleaning apparatus, after the cleaning process is completed, the vacuum pump is driven to initiate vacuum evacuation. Then, both vapor and liquid temperatures of the vapor generating chamber 8 show a tendency to smoothly increase. Here, the cleaning chamber 2 is gradually depressurized by the vacuum evacuation, reaches 900 Pa at about 150 seconds, and reaches 280 Pa that is a highest depressurizing level at about 418 seconds from the initiation of the vacuum evacuation.

In contrast, as shown in FIG. 4, in the vacuum cleaning apparatus 1 of the first embodiment, after the cleaning process is completed, the opening/closing valve 20 is opened to initiate drying. Similarly to the foregoing, the vapor and liquid temperatures of the vapor generating chamber 8 show a tendency to smoothly increase. On the other hand, since the vapor abruptly moves toward the condensing chamber 21, the cleaning chamber 2 is rapidly depressurized, reaches 900 Pa at about 12 seconds, and reaches 280 Pa that is the highest depressurizing level at about 22 seconds from the opening of the opening/closing valve 20.

Figure 5:
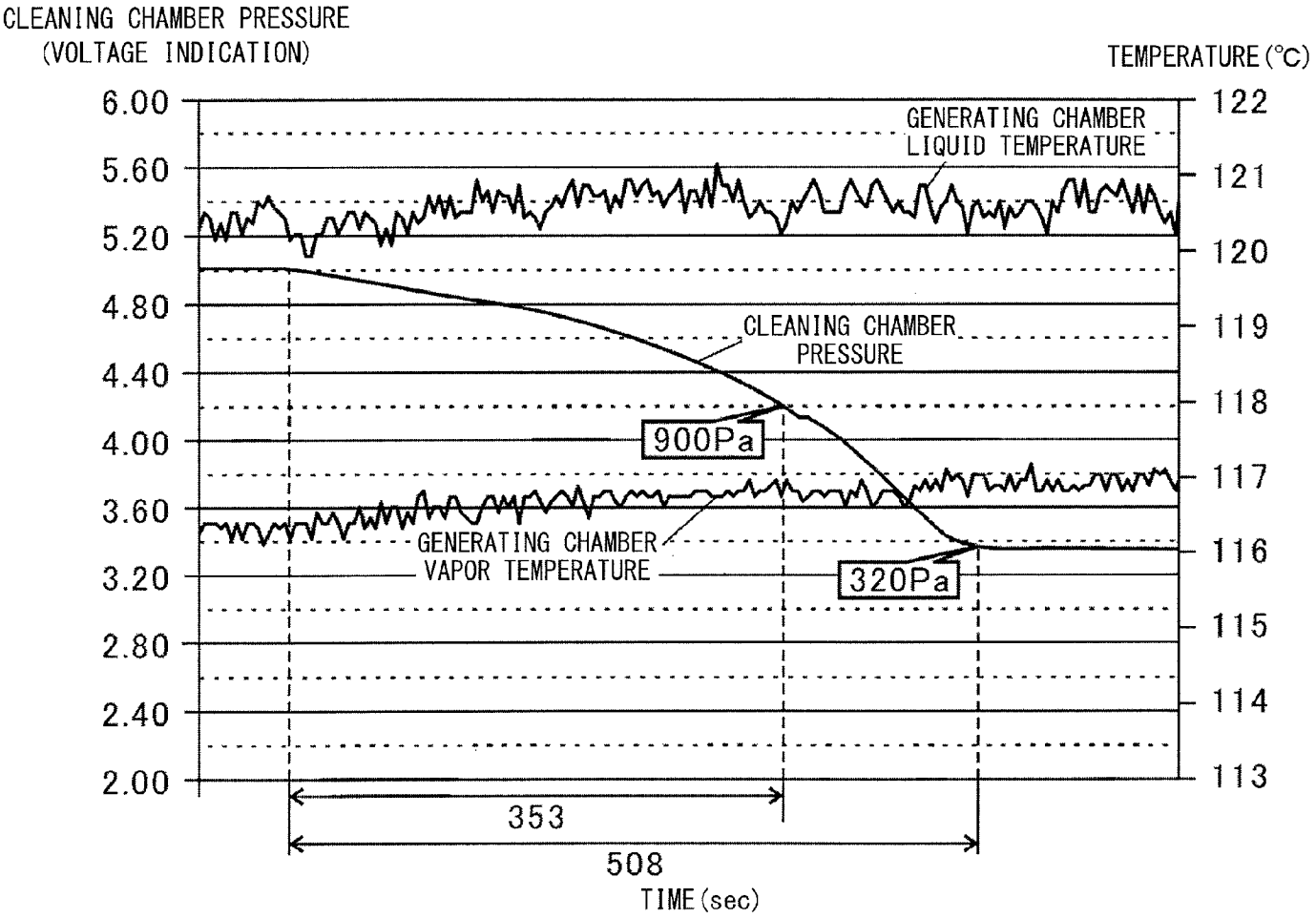
FIG. 5 is a diagram showing other test data of the drying process based on the conventional vacuum cleaning apparatus.
Figure 6:
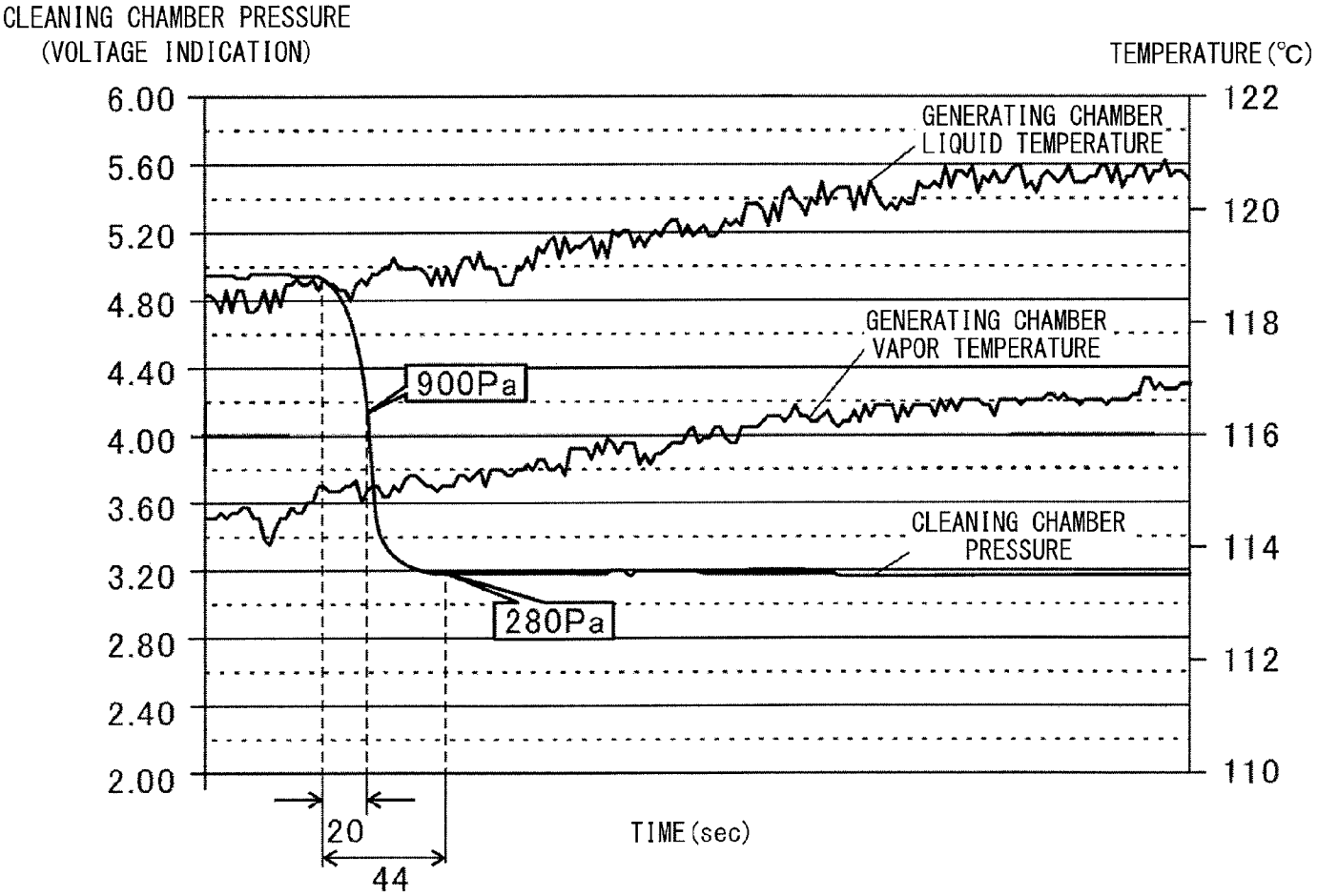
FIG. 6 is a diagram showing other test data of the drying process based on the vacuum cleaning apparatus 1 of the first embodiment.

Further, FIG. 5 is a diagram showing other test data of the drying process based on the conventional vacuum cleaning apparatus. FIG. 6 is a diagram showing other test data of the drying process based on the vacuum cleaning apparatus 1 of the first embodiment. FIGS. 5 and 6 show various data when 150 kg of the same small metal part as described above as the workpiece W and a steel can in which 70 cc of a petroleum-based solvent is stored are subjected to a drying process while placed in the cleaning chamber 2. In the cleaning process, the petroleum-based solvent is gathered in gaps and recesses in the part as a residual liquid. This test was performed under the assumption that such residual liquid was gathered.

As shown in FIG. 5, according to the conventional vacuum cleaning apparatus, the cleaning chamber 2 is gradually depressurized by the vacuum evacuation, reaches 900 Pa at about 353 seconds, and reaches 320 Pa that is a highest depressurizing level at about 508 seconds from the initiation of the vacuum evacuation. In other words, according to the conventional vacuum cleaning apparatus, when the residual liquid is gathered in the workpiece W in the cleaning process, a time required to reach the highest depressurizing level is increased by about 90 seconds, compared to when no residual liquid is gathered, and the pressure of the cleaning chamber 2 when reaching the highest depressurizing level is also further increased. Accordingly, it will be understood that, as the residual liquid gathered in the workpiece W increases, a time required for the drying process becomes longer.

In contrast, as shown in FIG. 6, according to the vacuum cleaning apparatus 1 of the first embodiment, the cleaning chamber 2 reaches 900 Pa at about 20 seconds after the opening of the opening/closing valve 20, and reaches 280 Pa that is the highest depressurizing level at about 44 seconds from the opening of the opening/closing valve 20. In other words, according to the vacuum cleaning apparatus 1 of the first embodiment, even when the residual liquid is gathered in the workpiece W in the cleaning process, a time required to reach the highest depressurizing level is increased only by about 22 seconds, compared to when no residual liquid is gathered, and the pressure of the cleaning chamber 2 when reaching the highest depressurizing level is also reduced to the same pressure as when no residual liquid is gathered.

In this way, in comparison with the vacuum cleaning apparatus 1 of the first embodiment and the conventional vacuum cleaning apparatus, it was confirmed that the time required for the drying process was remarkably reduced by using the vacuum cleaning apparatus 1 of the first embodiment, and that as the residual liquid gathered in the workpiece W increased, this time difference became more prominent. Thus, according to the vacuum cleaning apparatus 1, it is possible to reduce an overall treatment time due to the shortening of the drying process, to improve a throughput per unit time, and to realize the saving of energy. Furthermore, since the treatment time is shortened, it is possible to enhance cleaning accuracy in a short time by repeating the processes of steps S400 and S500 with respect to one workpiece.

Further, the petroleum-based solvent that has moved to and condensed in the condensing chamber 21 is guided to the reservoir tank 24 via the return pipe 23, is temporarily stored in the reservoir tank 24, and is then guided to and regenerated in the vapor generating chamber 8 again. Here, the petroleum-based solvent circulates in the interiors that are tightly closed from the exterior such as the cleaning chamber 2 and the condensing chamber 21. For this reason, in comparison with when the petroleum-based solvent is exhausted to the exterior by the conventional vacuum pump, a regeneration rate (reuse efficiency) of the petroleum-based solvent is very high. Accordingly, consumption of the petroleum-based solvent can be reduced, and running cost can be reduced.

Furthermore, in both the depressurizing process and the drying process of the conventional vacuum cleaning apparatus, the cleaning chamber is subjected to the vacuum evacuation by the vacuum pump. In this case, since a large quantity of vapor is suctioned from the cleaning chamber in the drying process, a vacuum pump having special specifications should be employed. For this reason, providing such a special part becomes a significant factor that increases the cost of the entire apparatus. In contrast, according to the vacuum cleaning apparatus 1 of the first embodiment, the vacuum pump is used only in the depressurizing process in which no vapor is present in the cleaning chamber 2. For this reason, it is possible to employ a vacuum pump having special specifications as well as general specifications, and to reduce the cost of the entire apparatus.

Next, vacuum cleaning apparatus of a second embodiment will be described using FIGS. 7 and 8. The vacuum cleaning apparatus 51 of the second embodiment is different from the vacuum cleaning apparatus 1 of the first embodiment in that a constitution for immersing and cleaning the workpiece W is added to the constitution of the vacuum cleaning apparatus 1 of the first embodiment. Accordingly, the same components as the first embodiment are given the same reference numbers as described above, and detailed description thereof will be omitted. Hereinafter, components different from those of the first embodiment will be described.

Figure 7:
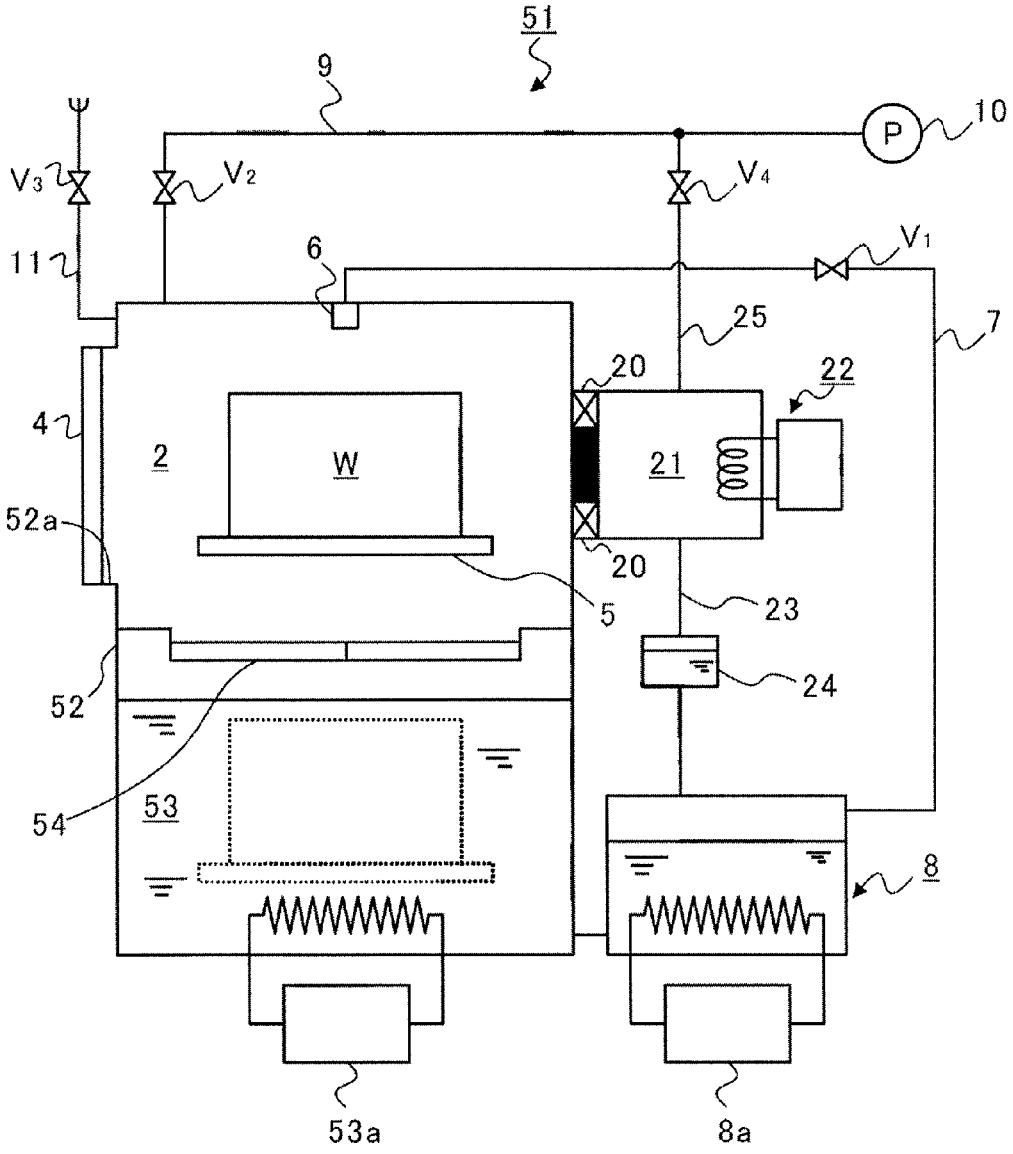
FIG. 7 is a conceptual diagram for describing vacuum cleaning apparatus of a second embodiment.
Figure 8:
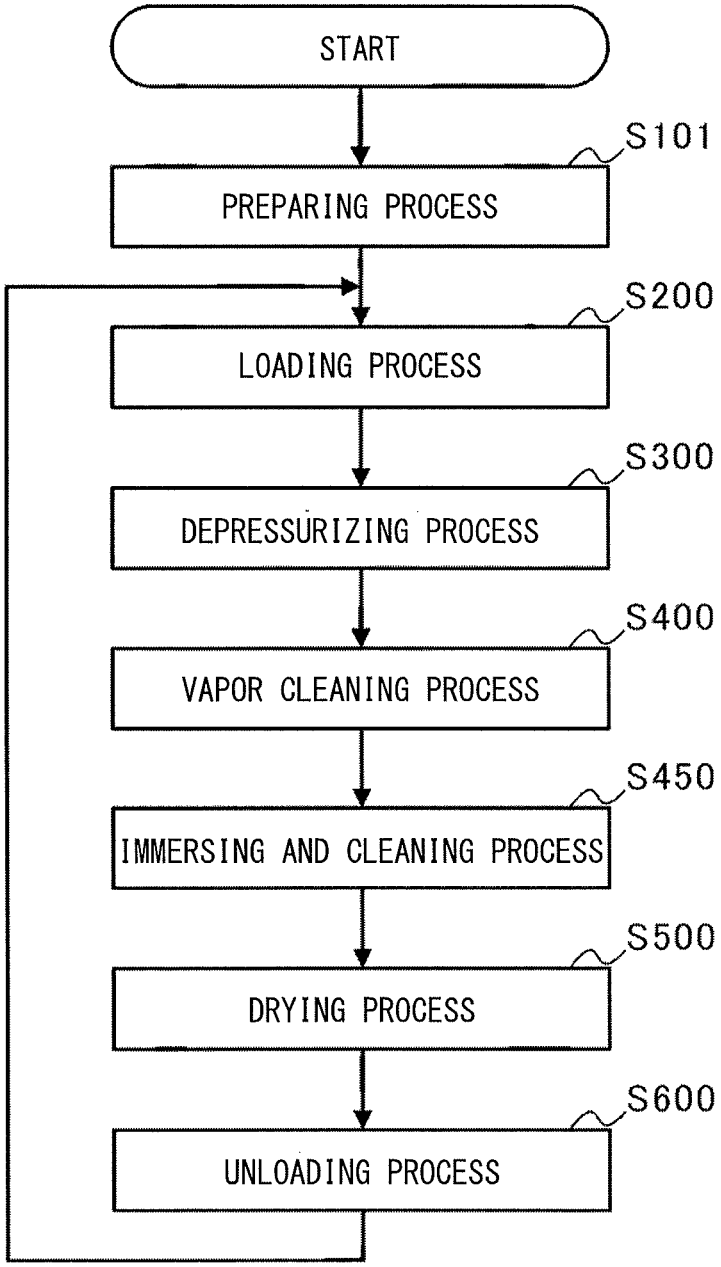
FIG. 8 is a flow chart describing treatment processes of the vacuum cleaning apparatus of the second embodiment.

FIG. 7 is a conceptual diagram for describing vacuum cleaning apparatus 51 of a second embodiment. As shown in this diagram, the vacuum cleaning apparatus 51 is provided with a vacuum container 52 in which a cleaning chamber 2 is installed. The vacuum container 52 is provided with an opening 52*a*, and the opening 52*a* can be opened and closed by an opening/closing door 4.

Further, an immersion chamber 53 disposed under the cleaning chamber 2 is installed in the vacuum container 52. In the immersion chamber 53, a petroleum-based solvent having a quantity in which the workpiece W can be completely immersed is stored in the immersion chamber 53. The immersion chamber 53 is provided with a heater 53*a* for heating the petroleum-based solvent. Further, an intermediate door 54 is installed between the cleaning chamber 2 and the immersion chamber 53. The intermediate door 54 brings the cleaning chamber 2 and the immersion chamber 53 in communication with each other, or cuts such communication off.

The petroleum-based solvent stored in the immersion chamber 53 is identical to vapor generated by a vapor generating chamber 8. Further, in the vacuum cleaning apparatus 51 of the second embodiment, a mounting part 5 is provided with a lifting device (not shown), and the mounting part 5 can be displaced in a vertical direction. Accordingly, in a state in which the intermediate door 54 is opened to cause the cleaning chamber 2 and the immersion chamber 53 to communicate with each other, the lifting device is driven. Thereby, as indicated in the diagram by a broken line, the lifting device can move the workpiece W from the cleaning chamber 2 to the immersion chamber 53, or move the workpiece W from the immersion chamber 53 to the cleaning chamber 2.

Next, a vacuum cleaning method of the workpiece W in the vacuum cleaning apparatus 51 will be described using FIGS. 7 and 8. FIG. 8 is a flow chart describing treatment processes of the vacuum cleaning apparatus 51. In using the vacuum cleaning apparatus 51, first, a preparing process (step S101) is performed once. Then, a loading process (step S200), a depressurizing process (step S300), a vapor cleaning process (step S400), an immersing and cleaning process (step S450), a drying process (step S500), and an unloading process (step S600) are performed on one workpiece W. Afterwards, the processes of steps S200 to S600 are performed on other workpieces W loaded in turn.

Among these processes, the loading process (step S200), the depressurizing process (step S300), the vapor cleaning process (step S400), the drying process (step S500), and the unloading process (step S600) are the same as in the first embodiment. Thus, here, the preparing process (step S101) and the immersing and cleaning process (step S450) different from those of the first embodiment will be described.

(Preparing Process: Step S101)

First, when the vacuum cleaning apparatus 51 is operated, switching valves $V_1$ to $V_4$ are closed, and the opening/closing door 4 is closed to cut off an interior of the vacuum container 52 from an exterior. Then, the intermediate door 54 is opened, and an opening/closing valve 20 is opened to cause the immersion chamber 53 and a condensing chamber 21 to communicate with the cleaning chamber 2. Next, the switching valve $V_2$ is opened to drive a vacuum pump 10, and the cleaning chamber 2, the immersion chamber 53, and the condensing chamber 21 are reduced to a pressure equal to or lower than 10 kPa by vacuum evacuation. Thereby, when the cleaning chamber 2, the immersion chamber 53, and the condensing chamber 21 are reduced up to a desired pressure, the intermediate door 54 is closed, and the opening/closing valve 20 is closed, cutting off the immersion chamber 53 and the condensing chamber 21 from the cleaning chamber 2.

Then, a temperature maintaining device 22 is driven to maintain the condensing chamber 21 that is in a depressurized state at a lower temperature than the cleaning chamber 2, and more particularly at a temperature equal to or lower than a condensation point of the petroleum-based solvent to be used. Further, the heater 53*a* is driven to heat the petroleum-based solvent stored in the immersion chamber 53, and a heater 8*a* is driven to heat the petroleum-based solvent stored in the vapor generating chamber 8, generating the vapor. Here, since the intermediate door 54 is closed, the vapor generated by the immersion chamber 53 is filled inside the immersion chamber 53. Further, since the switching valve $V_1$ is closed, the vapor generated by the vapor generating chamber 8 is filled inside the vapor generating chamber 8.

Next, to load the workpiece W into the cleaning chamber 2, the switching valve $V_3$ is opened, and the cleaning chamber 2 is exposed to the atmosphere and restored to atmospheric pressure. Then, when the cleaning chamber 2 is restored to atmospheric pressure, the switching valve $V_3$ is closed. Thereby, the preparing process of the vacuum cleaning apparatus 51 is completed, and the workpiece W can be cleaned by the vacuum cleaning apparatus 51.

Like the foregoing, when the loading process (step S200), the depressurizing process (step S300), and the vapor cleaning process (step S400) are completed, the immersing and cleaning process (step S450) is performed. In the vacuum cleaning apparatus 51 of the second embodiment, since the immersion chamber 53 is filled with the vapor, the intermediate door 54 is opened along with the initiation of the vapor cleaning process (step S400), and the cleaning chamber 2 and the immersion chamber 53 are brought in communication with each other. Accordingly, in the vapor cleaning process (step S400), the vapor is fed from both the vapor generating chamber 8 and the immersion chamber 53 to the cleaning chamber 2.

(Immersing and Cleaning Process: Step S450)

When the vapor cleaning process is completed, the mounting part 5 is lowered, and the workpiece W is immersed in the petroleum-based solvent stored in the immersion chamber 53. Here, the workpiece W repeats vertical upward and downward movements multiple times by means of the lifting device (not shown), and oils and fats adhered to minute portions of the workpiece W which could not be cleaned in the vapor cleaning process are cleaned. Thereby, when the cleaning of the workpiece W is completed, the mounting part 5 is raised to transfer the workpiece W to the cleaning chamber 2, and the intermediate door 54 is closed to cut off the cleaning chamber 2 and the immersion chamber 53.

Like the foregoing, the drying process (step S500) and the unloading process (step S600) are performed, and all the processes are thereby completed. In this way, according to the vacuum cleaning apparatus 51 of the second embodiment, it is possible to more precisely clean the workpiece W while realizing operations and effects similar to those of the vacuum cleaning apparatus 1 of the first embodiment. In the first embodiment, the vapor generating chamber 8 (and the heater 8*a*) functions as a vapor generating member for generating the vapor of the petroleum-based solvent. However, in the second embodiment, both the vapor generating chamber 8 (and the heater 8*a*) and the immersion chamber 53 (and the heater 53*a*) function as the vapor generating member.

While preferred embodiments of the present invention have been described with reference to the drawings, the present invention is not limited to these embodiments. It will be apparent to those skilled in the art that various modifications or alterations can be conceived and implemented within the scope described in the specification, and these modifications and alterations also fall within the technical scope of the present invention.

Accordingly, for example, when the high-temperature workpiece W is cleaned immediately after an annealing process is performed, the cleaning chamber 2 and the immersion chamber 53 may be configured to be installed apart from each other so that they do not easily transfer heat to each other. In this case, a low-temperature petroleum-based solvent may be stored in the immersion chamber 53. First, the workpiece W may be immersed in and cleaned by the low-temperature petroleum-based solvent, and the workpiece W cooled by the immersing and cleaning may be transferred to the cleaning chamber 2 and cleaned by the vapor. In this way, the sequence of each process performed on the workpiece W and the disposition of each chamber in the vacuum cleaning apparatus are not limited to the embodiments, and can be appropriately designed.

INDUSTRIAL APPLICABILITY

The present invention can be used in the vacuum cleaning apparatus and the vacuum cleaning method in which the vapor of the petroleum-based solvent is fed to the cleaning chamber under reduced pressure to clean the workpiece.

REFERENCE SIGNS LIST

1, 51 . . . vacuum cleaning apparatus
2 . . . cleaning chamber
8 . . . vapor generating chamber
8*a* . . . heater
10 . . . vacuum pump
20 . . . opening/closing valve
21 . . . condensing chamber
22 . . . temperature maintaining device
23 . . . return pipe
24 . . . reservoir tank
53 . . . immersion chamber
53*a* . . . heater
W . . . workpiece

The invention claimed is:

1. A vacuum cleaning apparatus comprising:
a vacuum pump;
a vapor generating member configured to generate vapor of a petroleum-based solvent;
a cleaning chamber configured to be placed under reduced-pressure atmosphere via the vacuum pump and to allow a workpiece to be cleaned under reduced pressure by the vapor fed from the vapor generating member;
a condensing chamber adjacent to the cleaning chamber and configured to be placed in a depressurized state via the vacuum pump, the condensing chamber configured to be kept in the depressurized state;
a temperature maintaining member configured to maintain the condensing chamber at a lower temperature than the cleaning chamber, and
an opening/closing valve configured to provide or cut off communication between the condensing chamber and the cleaning chamber,
wherein the opening/closing valve is configured to provide communication between the cleaning chamber and the condensing chamber to dry the workpiece after the workpiece is cleaned in the cleaning chamber.

2. The vacuum cleaning apparatus according to claim 1, wherein the temperature maintaining member is configured to maintain the temperature of the condensing chamber at a temperature equal to or lower than a condensation point of the petroleum-based solvent.

3. The vacuum cleaning apparatus according to claim 1, further comprising a collecting member configured to guide the petroleum-based solvent, which is guided and condensed from the cleaning chamber to the condensing chamber, from the condensing chamber to the vapor generating member.

4. The vacuum cleaning apparatus according to claim 1, further comprising an immersion chamber which is connected to the cleaning chamber, in which the petroleum-based solvent is stored, and which allows the workpiece to be immersed in the petroleum-based solvent.

5. The vacuum cleaning apparatus according to claim 2, further comprising an immersion chamber which is connected to the cleaning chamber, in which the petroleum-based solvent is stored, and which allows the workpiece to be immersed in the petroleum-based solvent.

6. The vacuum cleaning apparatus according to claim 3, further comprising an immersion chamber which is connected to the cleaning chamber, in which the petroleum-based solvent is stored, and which allows the workpiece to be immersed in the petroleum-based solvent.

7. A vacuum cleaning method comprising:
a process of depressurizing a cleaning chamber into which a workpiece is loaded and a condensing chamber adjacent to the cleaning chamber;
a process of generating vapor of a petroleum-based solvent and feeding the vapor to the cleaning chamber under reduced pressure to clean the workpiece;
a process of maintaining the condensing chamber under reduced pressure at a lower temperature than the cleaning chamber, and
a process of opening an opening/closing valve to provide communication between the condensing chamber kept in a depressurized state and the cleaning chamber after the workpiece is cleaned in the cleaning chamber.

8. A vacuum cleaning apparatus comprising:
a vacuum pump;
a vapor generating member configured to generate vapor of a petroleum-based solvent;
a cleaning chamber configured to be placed in a first depressurized state via the vacuum pump and to allow a workpiece to be cleaned under reduced pressure in the cleaning chamber by the vapor fed from the vapor generating member;
a condensing chamber adjacent to the cleaning chamber and configured to be placed in a second depressurized state by the vacuum pump, the condensing chamber being configured to be maintained in the second depressurized state;
a temperature maintaining member configured to maintain the condensing chamber at a lower temperature than the cleaning chamber, and
an opening/closing valve configured to provide or cut off communication between the condensing chamber and the cleaning chamber,
wherein the opening/closing valve is configured to provide communication between the cleaning chamber and the condensing chamber to dry the workpiece without use of the vacuum pump after the workpiece is cleaned in the cleaning chamber, and the condensing chamber is maintained in the second depressurized state after being placed in the second depressurized state until the opening/closing valve provides communication between the condensing chamber and the cleaning chamber.

9. A vacuum cleaning method comprising:
a process of depressurizing a cleaning chamber into which a workpiece is loaded and a condensing chamber adjacent to the cleaning chamber;
a process of generating vapor of a petroleum-based solvent and feeding the vapor to the cleaning chamber under reduced pressure to clean the workpiece;
a process of maintaining the condensing chamber in a depressurized state at a lower temperature than the cleaning chamber, and
a process of providing communication between the condensing chamber and the cleaning chamber after the workpiece is cleaned in the cleaning chamber, the condensing chamber being maintained in the depressurized state after being depressurized until communication is provided between the condensing chamber and the cleaning chamber, the process of providing communication between the condensing chamber and the cleaning chamber drying the workpiece without use of a vacuum pump.

* * * * *